US005578358A

United States Patent [19]

Foy et al.

[11] Patent Number: 5,578,358

[45] Date of Patent: Nov. 26, 1996

[54] PENETRATION-RESISTANT ARAMID ARTICLE

[75] Inventors: Brian E. Foy, Bear, Del.; Louis H. Miner, Kennett Square, Pa.

[73] Assignee: E. I. Du Pont de Nemours and Company, Wilmington, Del.

[21] Appl. No.: 421,350

[22] Filed: Apr. 12, 1995

[51] Int. Cl.[6] ..... B32B 3/06; D03D 3/00; F41H 1/02

[52] U.S. Cl. ..... 428/104; 428/229; 428/902; 428/911; 2/2.5; 139/420 A; 139/420 R

[58] Field of Search ..... 428/911, 229, 428/104, 902; 2/2.5; 139/420 R, 420 A

[56] References Cited

U.S. PATENT DOCUMENTS

| | | | |
|---|---|---|---|
| 4,183,097 | 1/1980 | Mellian | 2/2.5 |
| 4,737,401 | 4/1988 | Harpell et al. | 428/252 |
| 4,780,351 | 10/1988 | Czempoyesh | 428/122 |
| 4,868,040 | 9/1989 | Hallal et al. | 428/251 |
| 4,879,165 | 11/1989 | Smith . | |
| 5,021,283 | 6/1991 | Takenaka et al. | 428/116 |
| 5,073,441 | 12/1991 | Melec et al. . | |
| 5,185,195 | 2/1993 | Harpell et al. . | |
| 5,254,383 | 10/1993 | Harpell et al. . | |
| 5,322,721 | 6/1994 | McGinnis, Jr. et al. | 428/35.9 |

*Primary Examiner*—James D. Withers

[57] ABSTRACT

An aramid article is disclosed having improved resistance to penetration by sharp implements. The article is woven with tough, low denier, aramid yarns in a tight plain weave configuration; and, when used in several layers, the layers are not stitched together.

5 Claims, 1 Drawing Sheet

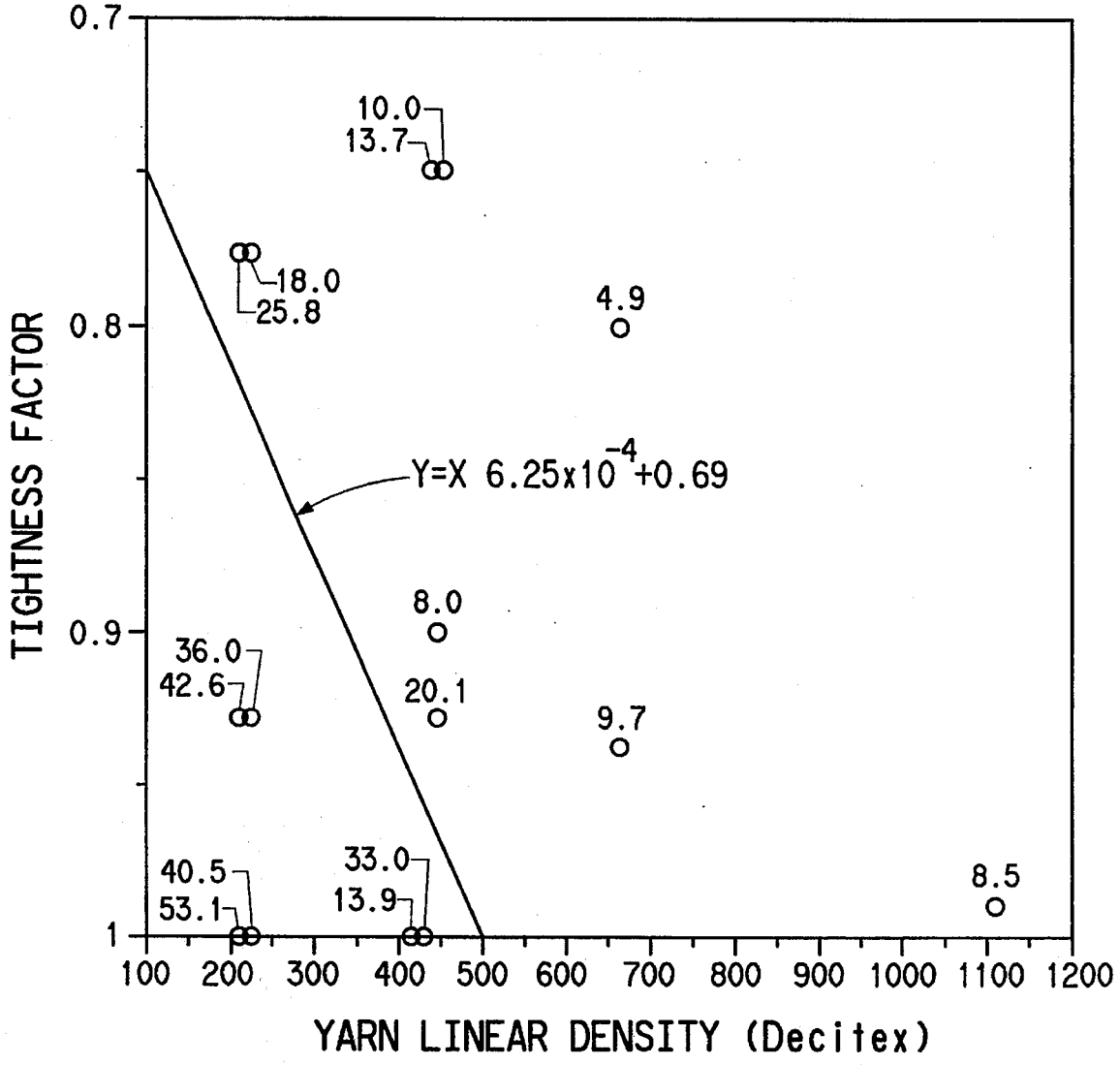
FIGURE

PENETRATION-RESISTANT ARAMID ARTICLE

BACKGROUND OF THE INVENTION

There has long been a need for protective garments exhibiting improved penetration resistance from sharp pointed implements. However, attention has been directed primarily toward ballistics and toward garments which provide protection from ballistics threats. This invention relates to articles which protect from penetration, such as stabs or thrusts from sharp instruments such as awls or ice picks.

U.S. Pat. No. 5,073,441, issued Dec. 17, 1991 on the application of Melec et al., discloses a penetration resistant structure made from knitted polyaramide yarn. This structure can be used as a protective netting or can be impregnated by a matrix resin to provide a more or less rigid protective structure.

U.S. Pat. No. 4,879,165, issued Nov. 7, 1989 on the application of Smith, discloses an armor especially modified to improve penetration resistance by use of ionomer matrix resins and ceramic or metallic grit or platelets in addition to aramid or linear polyethylene fibers.

U.S. Pat. No. 5,185,195, issued Feb. 9, 1993 on the application of Harpell et al., discloses a penetration resistant construction wherein adjacent layers of woven aramid or linear polyethylene fabric are affixed together by regular paths less than 0.32 centimeter (0.125 inch) apart. The affixing is preferably by means of stitching. The penetration resistance can be additionally improved by use of a layer of rigid, overlapping, platelets.

U.S. Pat. No. 5,254,383, issued Oct. 19, 1993 on the application of Harpell et al., discloses a composite with improved penetration resistance utilizing a multitude of overlapping and mutually attached, so-called, planar bodies of ceramic or metal wrapped with fibrous layers to prevent a sharp instrument from slipping off of and between individual planar bodies.

International Publication Number WO 93/00564, published Jan. 7, 1993, discloses ballistics structures using multiple layers of fabric woven from high tenacity para-aramid yarn. There is no suggestion of using the structures for penetration or stab resistance; the yarns are high linear density; and the fabrics, apparently, have low fabric tightness factors.

SUMMARY OF THE INVENTION

This invention relates to a penetration resistant article consisting essentially of fabric woven to a fabric tightness factor of at least 0.75 from aramid yarn having a linear density of less than 500 dtex and a toughness of at least 30 Joules/gram. The invention also relates to such a penetration resistant article wherein at least two layers of the fabric are included in the article, and are joined at edges of the article in a manner such that adjacent layers of the fabric are free to move relative to each other.

BRIEF DESCRIPTION OF THE DRAWINGS

The FIGURE is a graphical representation of the relationship between linear density for yarns and fabric tightness factor for fabrics of this invention.

DETAILED DESCRIPTION

The protective article of this invention was specially developed to provide protection from penetration by sharp instruments as opposed to protection from ballistic threats. There has been considerable effort expended in the past on improvement of ballistic garments; and many times the assumption has been that improved ballistic garments will also exhibit improved stab resistance or penetration resistance. The inventors herein have found that assumption to be incorrect and they have discovered a fabric article with a combination of several necessary qualities which does, indeed, exhibit improved penetration resistance.

Ballistic garments are made using several layers of protective fabric and the several layers are nearly always fastened together in a way to hold faces of the adjacent layers in position relative to each other. The layers are usually stitched together to form a unitary body of substantial thickness; made up of layers, but having the layers sewn together over the area of the garment. The inventors herein have discovered that stab resistance is improved if adjacent layers in a protective garment are not held together; but are free to move relative to each other. When adjacent layers are stitched together, stab resistance is decreased.

The invention herein is constructed entirely of woven fabric without rigid plates or platelets and without matrix resins impregnating the fabric materials. The articles of this invention are more flexible and lighter in weight than penetration resistant constructions of the prior art offering comparable protection.

Fabrics of the present invention are made from yarns of aramid fibers. By "aramid" is meant a polyamide wherein at least 85% of the amide (—CO—NH—) linkages are attached directly to two aromatic rings. Suitable aramid fibers are described in Man-Made Fibers—Science and Technology, Volume 2, Section titled Fiber-Forming Aromatic Polyamides, page 297, W. Black et al., Interscience Publishers, 1968. Aramid fibers are, also, disclosed in U.S. Pat. Nos. 4,172,938; 3,869,429; 3,819,587; 3,673,143; 3,354,127; and 3,094,511.

Additives can be used with the aramid and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride or the aramid.

Para-aramids are the primary polymers in yarn fibers of this invention and poly(p-phenylene terephthalamide)(PPD-T) is the preferred para-aramid. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride or 3,4'-diaminodiphenylether. Preparation of PPD-T is described in U.S. Pat. Nos. 3,869,429; 4,308,374; and 4,698,414.

"Fabric tightness factor" and "Cover factor" are names given to the density of the weave of a fabric. Cover factor is a calculated value relating to the geometry of the weave and indicating the percentage of the gross surface area of a fabric which is covered by yarns of the fabric. The equation used to calculate cover factor is as follows (from Weaving: Conversion of Yarns to Fabric, Lord and Mohamed, published by Merrow (1982), pages 141–143):

$d_w$=width of warp yarn in the fabric $d_f$=width of fill yarn in the fabric $P_w$=pitch of warp yarns (ends per unit length)

$p_f$=pitch of fill yarns $$C_w = \frac{d_w}{pw} \qquad C_f = \frac{d_f}{pf}$$

$$\text{Fabric Cover Factor} = C_{fab} = \frac{\text{total area obscured}}{\text{area enclosed}}$$

$$\begin{aligned} C_{fab} &= \frac{(p_w - d_w)d_f + d_w p_f}{p_w p_f} \\ &= (C_f + C_w - C_f C_w) \end{aligned}$$

Depending on the kind of weave of a fabric, the maximum cover factor may be quite low even though the yarns of the fabric are situated close together. For that reason, a more useful indicator of weave tightness is called the "fabric tightness factor". The fabric tightness factor is a measure of the tightness of a fabric weave compared with the maximum weave tightness as a function of the cover factor.

$$\text{Fabric tightness factor} = \frac{\text{actual cover factor}}{\text{maximum cover factor}}$$

For example, the maximum cover factor which is possible for a plain weave fabric is 0.75; and a plain weave fabric with an actual cover factor of 0.68 will, therefore, have a fabric tightness factor of 0.91. The preferred weave for practice of this invention is plain weave.

While aramid yarns are available in a wide variety of linear densities, it has been determined by the inventors herein that acceptable penetration resistance can be obtained only when the linear density of the aramid yarns is less than 500 dtex. Aramid yarns of greater than 500 dtex, even when woven to a fabric tightness factor of nearly 1.0, are believed to yield between the adjacent yarns and permit easier penetration of a sharp instrument. The improvement in penetration resistance of this invention can be expected to continue to very low linear densities; but, at about 100 dtex, the yarns begin to become very difficult to weave without damage. With that in mind, the aramid yarns of this invention have a linear density of from 100 to 500 dtex.

It is a major element of the discovery herein that excellence of penetration resistance is a function of the combination of linear density of the yarn and tightness factor of the fabric made from the yarn. Reference is made to the FIGURE which is a graphical representation of the data points from the tests performed in Example 1 herein. Each point on the graph represents the test results from one of the fabrics, is located by tightness factor of the fabric and linear density of the yarn, and is identified by the so-called specific penetration resistance determined in the test.

As will be explained later herein, specific penetration resistance decreases as resistance to penetration decreases and a value of about 30 for specific penetration in the tests conducted herein is considered to represent adequate penetration resistance for general use. The line identified as $Y=X\ 6.25\times10^{-4}+0.69$ separates adequate penetration resistance from inadequate penetration resistance for fabrics in the FIGURE made from aramid yarns.

There is one point on the "adequate penetration resistance" side of the line which exhibits inadequate penetration resistance; but that point represents a fabric made from yarn which was not aramid.

Good penetration resistance requires a combination of several yarn and fabric qualities, among which are yarn linear density and fabric tightness factor. From the FIGURE, it can be seen that, for aramid fibers, good penetration resistance will be afforded by fabrics with a combination of tightness factor and linear yarn density which falls under the curve in the range of 0.75 to 1.0 and 500 to 100 decitex, respectively.

The aramid yarns used in this invention must have a high tenacity combined with a high elongation to break to yield a high toughness. The tenacity should be at least 19 grams per dtex (21.1 grams per denier) and there is no known upper limit for tenacity. Below about 11.1 grams per dtex, the yarn doesn't exhibit adequate strength for meaningful protection. The elongation to break should be at least 3.0 percent and there is no known upper limits for elongation. Elongation to break which is less than 3.0 percent results in a yarn which is brittle and yields a toughness which is less than necessary for the protection sought herein.

"Toughness" is a measure of the energy absorbing capability of a yarn up to its point of failure in tensile stress/strain testing. Toughness is sometimes, also, known as "Energy to Break". Toughness or Energy to Break is a combination of tenacity and elongation to break and is represented by the area under the stress/strain curve from zero strain to break. In the work which led to this invention, it was discovered that a slight increase in tenacity or elongation to break results in a surprisingly large improvement in penetration resistance. A yarn toughness of at least 35 Joules/gram is believed to be necessary for adequate penetration resistance in practice of this invention; and a toughness of at least 38 Joules/gram is preferred.

A single layer of the woven article of this invention does provide a measure of penetration resistance and, therefore, a degree of protection; but a plurality of layers are usually used in an ultimate product. It is in the use of a plurality of layers that the present invention exhibits its most pronounced and surprising improvement. The inventors herein have discovered that articles of this invention, when placed together in a plurality of layers, afford a surprisingly effective penetration resistance when the articles are not affixed to one another so as to permit relative movement between adjacent layers. Adjacent layers or articles may be fastened at the edges or there may be some loose interlayer connections at relatively great spacings compared with the thickness of the articles. For instance, layer-to-layer attachments at point spacings of greater than about 15 centimeters would serve, for this application, as being substantially free from means for holding the layers together. Layers which have been stitched together over the surface of the layers may provide more effective ballistics protection; but such stitching causes immobility between the layers and, for reasons not entirely understood, actually decreases the penetration resistance of the layers as compared with expectations based on single layer tests.

TEST METHODS

Linear Density.

The linear density of a yarn is determined by weighing a known length of the yarn. "Dtex" is defined as the weight, in grams, of 10,000 meters of the yarn. "Denier" is the weight, in grams, of 9000 meters of the yarn.

In actual practice, the measured dtex of a yarn sample, test conditions, and sample identification are fed into a computer before the start of a test; the computer records the load-elongation curve of the yarn as it is broken and then calculates the properties.

Tensile Properties.

Yarns tested for tensile properties are, first, conditioned and, then, twisted to a twist multiplier of 1.1. The twist multiplier (TM) of a yarn is defined as:

$$TM = (\text{twists/cm})/(\text{dtex})^{-1/2}/30.3$$
$$= (\text{twists/inch})(\text{denier})^{-1/2}/73$$

The yarns to be tested are conditioned at 25° C., 55% relative humidity for a minimum of 14 hours and the tensile tests are conducted at those conditions. Tenacity (breaking tenacity), elongation to break, and modulus are determined by breaking test yarns on an Instron tester (Instron Engineering Corp., Canton, Mass.).

Tenacity, elongation, and initial modulus, as defined in ASTM D2101-1985, are determined using yarn gage lengths of 25.4 cm and an elongation rate of 50% strain/minute. The modulus is calculated from the slope of the stress-strain curve at 1% strain and is equal to the stress in grams at 1% strain (absolute) times 100, divided by the test yarn linear density.

Toughness.

Using the stress-strain curve from the tensile testing, toughness is determined as the area (A) under the stress/strain curve up to the point of yarn break. It is usually determined employing a planimeter, to provide area in square centimeters. Dtex (D) is as described above under "Linear Density". Toughness (To) is calculated as $$To=A\times(FSL/CFS)(CHS/CS)(1/D)(1/GL)$$

where

FSL=full-scale load in grams

CFS=chart full scale in centimeters

CHS=crosshead speed in cm/min

CS=chart speed in cm/min

GL=gauge length of test specimen in centimeters

Digitized stress/strain data may, of course, be fed to a computer for calculating toughness directly. The result is To in dN/tex. Multiplication by 1.111 converts to g/denier. When units of length are the same throughout, the above equation computes To in units determined only by those chosen for force (FSL) and D.

Penetration Resistance.

Penetration resistance is determined on articles of a single layer or a few layers by a standard method for Protective Clothing Material Resistance to Puncture identified as ASTM F1342. In that test, the force is measured which is required to cause a sharply pointed puncture probe to penetrate a specimen. The specimen is clamped between flat metal sheets with opposing 0.6 cm holes and placed 2.5 cm below the puncture probe mounted in a testing machine set to drive the probe through the specimen at the holes in the metal sheets at a rate of 50.8 cm/minute. The maximum force before penetration is reported as the penetration resistance.

Penetration resistance is determined on a plurality of layers of the articles using either a tempered steel awl 18 centimeters (7 inches) long and 0.64 centimeter (0.25 inch) in shaft diameter having a Rockwell hardness of C-45 or an ice pick of the same length, a shaft diameter of 0.42 centimeter and a Rockwell hardness of C-42. The tests are conducted in accordance with HPW test TP-0400.02 (22 Jul. 1988) from H. P. White Lab., Inc. The test samples are impacted with the awl, weighted to 7.35 kilograms (16.2 pounds) and dropped from various heights. Results are reported as degree of penetration and deformation.

EXAMPLES

Example 1

In this example, several fibers were woven using a variety of yarns in plain weave at a variety of fabric tightness factors.

The yarns were:

| Yarn | Tenacity (gm/dtex) | Elongation (%) | Energy to Break (Joules/gm) | Linear Density (dtex) |
|---|---|---|---|---|
| A | 30.1 | 3.4 | 41.2 | 220 |
| B | 25.4 | 3.0 | 31.2 | 220 |
| C | 26.6 | 3.2 | 33.9 | 440 |
| D | 25.5 | 3.4 | 34.2 | 1110 |
| E | 30.0 | 3.4 | 40.5 | 440 |
| F | 31.1 | 3.4 | 41.4 | 670 |
| G | 30.0 | 3.4 | 40.5 | 440 |
| H | 38.8 | 3.1 | 47.8 | 415 |

Yarns A–G are poly(p-phenylene terephthalamide) (PPD-T) yarns sold by E. I. du Pont de Nemours and Company.

Yarn A bears the trademark designation KEVLAR® 159.

Yarns B–D bear the trademark designation KEVLAR® 29.

Yarns E and F bear the trademark designation KEVLAR® 129.

Yarn G bears the trademark designation KEVLAR® LT.

Yarn H is high molecular weight linear polyethylene yarn sold by AlliedSignal under the trademark designation SPECTRA® 1000.

The fabrics were:

| Fabric # | Yarn Used | Yarn End Count (cm × cm) | Basis Wt. (g/m²) | Tightness Factor |
|---|---|---|---|---|
| 1-1 | A | 27.6 × 27.6 | 128 | 1.0 |
| 1-2 | A | 24.8 × 24.8 | 115 | 0.93 |
| 1-3 | A | 19.7 × 19.7 | 89 | 0.78 |
| 1-4 | B | 27.6 × 27.6 | 126 | 1.0 |
| 1-5 | B | 24.8 × 24.8 | 115 | 0.93 |
| 1-6 | B | 19.7 × 19.7 | 89 | 0.78 |
| 1-7 | C | 19.7 × 19.7 | 182 | 1.0 |
| 1-8 | D | 12.2 × 12.2 | 282 | 0.99 |
| 1-9 | E | 17.3 × 17.3 | 159 | 0.93 |
| 1-10 | E | 13.4 × 13.4 | 120 | 0.75 |
| 1-11 | F | 14.6 × 14.6 | 206 | 0.94 |
| 1-12 | F | 11.8 × 11.8 | 164 | 0.80 |
| 1-13 | G | 13 × 13 | 125 | 0.75 |
| 1-14 | G | 16 × 16 | 139 | 0.90 |
| 1-15 | H | 20.1 × 19.7 | 173 | 1.0 |

All of the fabrics were tested, as one and two-ply configurations, in accordance with ASTM F1342, as previously described. The test results are reported in Table 1 as absolute penetration resistance (grams) and as specific penetration resistance (absolute/basis weight) for both one and two-ply configurations.

TABLE 1

| Fabric # | Tightness Factor | No. of Plies | Basis Wt. ($g/m^2$) | Penetration Resistance Absolute (grams) | Specific Resist. | No. of Tests |
|---|---|---|---|---|---|---|
| 1-1 | 1.0 | 1 | 128 | 6,800 | 53.1 | 3 |
| | | 2 | 256 | 15,400 | 60.2 | 3 |
| 1-2 | 0.93 | 1 | 115 | 4,900 | 42.6 | 3 |
| | | 2 | 230 | 11,300 | 49.1 | 5 |
| 1-3 | 0.78 | 1 | 89 | 2,300 | 25.8 | 6 |
| | | 2 | 178 | 4,400 | 24.7 | 3 |
| 1-4 | 1.0 | 1 | 126 | 5,100 | 40.5 | 6 |
| | | 2 | 252 | 11,400 | 45.2 | 3 |
| 1-5 | 0.93 | 1 | 114 | 4,100 | 36.0 | 9 |
| | | 2 | 229 | 8,100 | 35.4 | 7 |
| 1-6 | 0.78 | 1 | 89 | 1,600 | 18.0 | 9 |
| | | 2 | 178 | 3,600 | 20.2 | 7 |
| 1-7 | 1.0 | 1 | 182 | 6,000 | 33.0 | 9 |
| 1-8 | 0.99 | 1 | 282 | 2,400 | 8.5 | 5 |
| | | 1 (repeat) | | 2,200 | 7.8 | 3 |
| 1-9 | 0.93 | 1 | 159 | 3,200 | 20.1 | 5 |
| | | 2 | 318 | 8,700 | 27.4 | 3 |
| 1-10 | 0.75 | 1 | 120 | 1,200 | 10.0 | 5 |
| | | 2 | 240 | 3,900 | 16.2 | 3 |
| 1-11 | 0.94 | 1 | 206 | 2,000 | 9.7 | 6 |
| | | 2 | 412 | 4,100 | 10.0 | 6 |
| 1-12 | 0.80 | 1 | 164 | 800 | 4.9 | 6 |
| | | 2 | 328 | 2,600 | 7.9 | 6 |
| 1-13 | 0.75 | 1 | 139 | 1,900 | 13.7 | 6 |
| 1-14 | 0.90 | 1 | 125 | 1,000 | 8.0 | 6 |
| 1-15 | 1.0 | 1 | 173 | 2,300 | 13.3 | 6 |
| | | 2 | 346 | 4,600 | 13.3 | 6 |

Specific penetration resistance values for the single ply configurations from those tests were placed on a graphical field of yarn decitex versus fabric tightness factor, as shown in the FIGURE. The values fall into two easily-characterized areas. On one side of a line of the equation $Y=X\ 6.25\times10^{-4}+0.69$ (where Y is tightness factor and X is linear yarn density in decitex) the fabrics have adequate penetration resistance; and, on the other side of the line, penetration resistance is inadequate.

From these test results, it is seen that fabrics of this invention are made from yarns of aramid having linear yarn density from 100 to 500 decitex and which are woven to a fabric tightness factor of at least 0.75 in accordance with the following formula:

$$Y=\text{or}>X\ 6.25\times10^{-4}+0.69$$

wherein Y=Fabric Tightness Factor and X=Linear Yarn Density.

Example 2

In this example, multiple plies of fabrics 1-1 and 1-4 were tested for penetration resistance in accordance with the aforementioned falling awl procedure. Ten plies of each of those fabrics were laid together on a backing of Roma "Plastilina" #1 modeling clay and the weighted awl was dropped at various heights until penetration was achieved by the awl. Fabric 1-1 resisted penetration up to 27.4 Joules of drop energy and fabric 1-4 resisted penetration up to 18.3 Joules.

When this test was repeated using twenty plies of the fabrics and the sharper, aforementioned, ice pick, fabric 1-1 resisted penetration up to 18.3 Joules and fabric 1-4 resisted penetration up to 14.6 Joules.

As a further test of these fabrics in configurations which are embraced by this invention, twenty plies of fabric 1-1 were laid together free from means for holding the layers of fabric together; and were tested in accordance with the falling awl procedure using the aforementioned awl. As a control, twenty plies of the same fabric were quilted together in 5 centimeter squares using 40 tex cotton thread and the quilted plies were, also, tested. The sole difference between the configurations was that the configuration of this invention had no quilting and resisted penetration up to 54.9 Joules while the control was, as stated, quilted in 5 centimeter squares and resisted penetration up to 36.6 Joules—only two-thirds as much.

What is claimed is:

1. A flexible, penetration resistant, article consisting essentially of fabric woven to a fabric tightness factor of at least 0.75 from aramid yarn having a linear density of less than 500 dtex and a toughness of at least 30 Joules/gram, wherein the relationship between the fabric tightness factor and the linear density of the yarn is $$Y=\text{or}>X\ 6.25\times10^{-4}+0.69$$

wherein

Y=fabric tightness factor and

X=linear yarn density.

2. The penetration resistant article of claim 1 wherein at least two layers of the fabric are included in the article, are joined at edges of the article, and are otherwise substantially free from means for holding the layers of fabric together.

3. The article of claim 1 wherein the fabric tightness factor is substantially 1.0.

4. The article of claim 1 wherein the toughness is at least 40 Joules/gram.

5. The article of claim 1 wherein the aramid yarn is poly(p-phenylene terephthalamide).

* * * * *